US008550178B2

(12) United States Patent
Xu et al.

(10) Patent No.: US 8,550,178 B2
(45) Date of Patent: Oct. 8, 2013

(54) EXPANDABLE ISOLATION PACKER

(75) Inventors: Richard Y. Xu, Tomball, TX (US); Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 282 days.

(21) Appl. No.: 13/044,072

(22) Filed: Mar. 9, 2011

(65) Prior Publication Data

US 2012/0227957 A1 Sep. 13, 2012

(51) Int. Cl.
*E21B 33/12* (2006.01)

(52) U.S. Cl.
USPC ..... 166/387; 166/207; 166/217; 166/384; 277/339; 277/340

(58) Field of Classification Search
USPC ..... 166/207, 217, 384, 387; 277/339, 277/340
See application file for complete search history.

(56) References Cited

U.S. PATENT DOCUMENTS

| | | | | |
|---|---|---|---|---|
| 5,333,692 | A | 8/1994 | Baugh et al. | |
| 6,854,521 | B2 | 2/2005 | Echols et al. | |
| 7,117,949 | B2 | 10/2006 | Doane et al. | |
| 7,350,584 | B2 | 4/2008 | Simpson et al. | |
| 7,360,592 | B2 | 4/2008 | McMahan | |
| 7,387,168 | B2 | 6/2008 | Ellington et al. | |
| 7,431,078 | B2 | 10/2008 | Carmody et al. | |
| 2003/0080515 | A1* | 5/2003 | Milberger et al. | 277/603 |
| 2005/0269108 | A1 | 12/2005 | Whanger et al. | |
| 2007/0267824 | A1* | 11/2007 | Baugh et al. | 277/607 |
| 2009/0205843 | A1 | 8/2009 | Gandikota et al. | |
| 2010/0212899 | A1* | 8/2010 | Huang et al. | 166/285 |
| 2010/0314130 | A1 | 12/2010 | Durst et al. | |

* cited by examiner

*Primary Examiner* — Kenneth L Thompson
*Assistant Examiner* — Taras P Bemko
(74) *Attorney, Agent, or Firm* — Steve Rosenblatt

(57) ABSTRACT

An expandable packer features a sealing element in an exterior recess that is straddled by projections or bumps. Upon expansion the bumps move out against the borehole wall as an anchor support. Optionally, the bumps may be covered with a sealing material and may be constructed to assist in their radial movement to the borehole wall as a result of expansion particularly if the mandrel is expanded in compression. The bumps are not necessarily expanded with the swage and their radial growth can be induced from longitudinal shrinkage resulting from radial expansion.

23 Claims, 5 Drawing Sheets

EXPANDABLE ISOLATION PACKER

FIELD OF THE INVENTION

The field of the invention is packers that are set by expansion of the mandrel and more particularly with a recess feature for the element to give it protection for run in with the adjacent bumps also acting as grip locations.

BACKGROUND OF THE INVENTION

Packers are isolation devices that are mounted to a tubular mandrel. Some are set with compression of a sealing element external to the mandrel to reduce the length of the sealing element and increase its radial dimension. Other designs expand the mandrel from within to bring the sealing element to the borehole wall. Some designs employ swelling elements to bridge the gap to the borehole wall after exposure to well fluids over a period of time.

One recurring issue with packers is that they must be run into the well through a tubular with a drift dimension not much larger than the packer run in dimension and then the packer may have to be set in a much larger borehole. Packers with expandable mandrels have typically put the sealing element on the outside diameter of the mandrel leaving the sealing element exposed to damage during running in. US Publication 2010/0314130 puts the sealing elements on the mandrel outer diameter and uses a system of internal rings through which the swage has to pass to expand only at the seal locations with a resulting uniform internal diameter after expansion since the size of the swage is no larger than the drift diameter of the tubular being expanded.

Other designs place gripping members adjacent a sealing element and expand the mandrel from its interior. In this design the assembly is placed on the mandrel outer diameter which limits the initial internal dimension of the mandrel for run in which makes it more difficult to expand to a sealing condition in a larger wellbore. Such a design is illustrated in U.S. Pat. No. 7,117,949.

Other designs that are focused on using lighter wall pipe and giving it strength to resist collapse with a series of closely spaced corrugations make the claim that a sealing material can be deployed in the corrugations and a roller expander can be used to enlarge the corrugated segment with the sealing material for use as an isolation device. It claims protection for the sealing material during run in via the corrugations. The reality is that if the corrugations act as protection for a sealing material in a helical or circumferential groove then to try to get a seal with expansion will require elimination of the groove to even get the seal against the borehole wall. If that happens then the seal material will comprise of thin unsupported strips as the corrugations will be eliminated to even get sealing contact. The unsupported strips will roll on themselves and will not provide a reasonable annular seal. On the other hand if the corrugations are buried for run in then the sealing element is not protected for run in by the corrugations. Also a factor is that since the corrugations enable the use of thinner wall tubulars the expansion to the point of returning to parallel wall structure by flattening out all the corrugations will present a weaker mandrel that will have a fairly low differential pressure rating and may be too weak to retain the sealing element against the borehole wall in a sealing relationship. Such a design is illustrated in U.S. Pat. No. 7,350,584.

What is needed and provided by the present invention is an expandable packer that can have the element protected for run in while still be configured to sealingly be expanded to the surrounding wellbore. These features are addressed by projections on opposed ends of long recesses that hold the sealing element. The projections can extend radially upon expansion to act as anchors or extrusion barriers. A swelling material can optionally be used. Those skilled in the art will better understand the invention from a review of the description of the preferred embodiment and the associated drawings while recognizing that the full scope of the invention is to be determined from the appended claims.

SUMMARY OF THE INVENTION

An expandable packer features a sealing element in an exterior recess that is straddled by projections or bumps. Upon expansion the bumps move out against the borehole wall as an anchor support. Optionally, the bumps may be covered with a sealing material and may be constructed to assist in their radial movement to the borehole wall as a result of expansion particularly if the mandrel is expanded in compression. The bumps are not necessarily expanded with the swage and their radial growth can be induced from longitudinal shrinkage resulting from radial expansion. Shrinkage from expansion occurs from axial loading in compression from the swage to be advanced and it also occurs as a consequence of radial expansion resulting from advancing of the swage.

DETAILED DESCRIPTION OF THE PREFERRED EMBODIMENT

Figure 1:
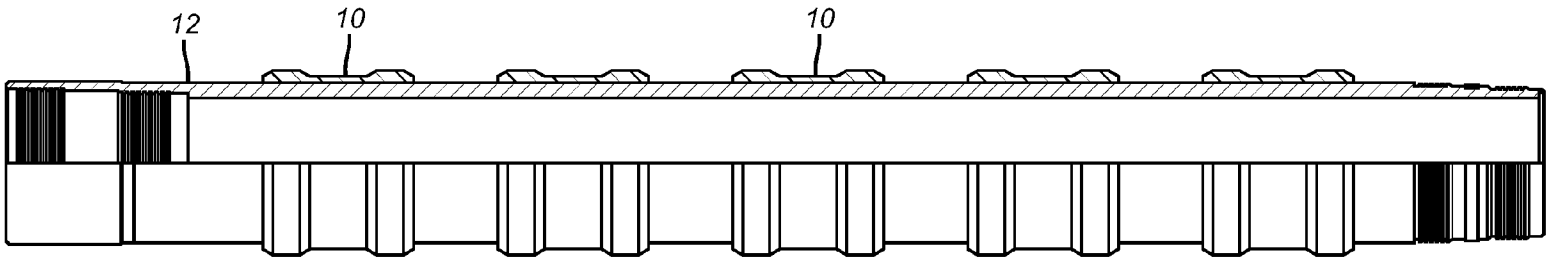
(PRIOR ART) FIG. 1
FIG. 1 is a prior art arrangement of elements on a mandrel to be expanded.

FIG. 1 illustrates multiple elements 10 on a mandrel 12 that is to be expanded. The mandrel 12 has a constant outer dimension and the elements 10 are exposed to damage for run in. The thickness of the seals 10 is limited by the drift dimension of the previously installed or existing tubular and the outside diameter of the mandrel.

Figure 2:
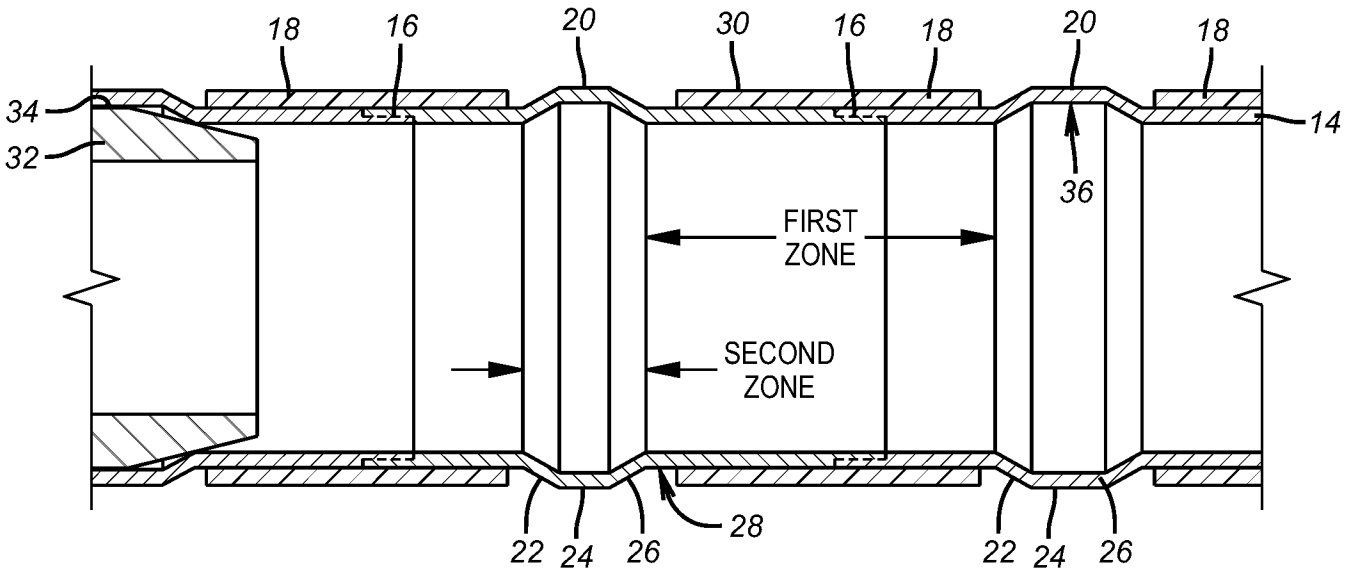
FIG. 2 is a section view of one embodiment with external recesses for the sealing elements and bumps between the elements that are uncovered with a seal material.

FIG. 2 has a mandrel 14 that has threaded connections 16 that are located preferably under seals 18. While three are shown one or more seals 18 can be used. A series of humps 20 straddle at least some seals 18 and may bracket each seal 18. The humps 20 can be formed of multiple segments 22, 24 and 26 with segments 22 and 26 tapered with respect to a longitudinal axis of mandrel 14 while segment 24 is substantially parallel to the longitudinal axis of mandrel 14. Segments 22 on one side of a seal 18 and 26 on the other side of a seal 18 define a valley 28 which allows a greater thickness for the seal 18 while maintaining segment 24 as the largest dimension. Segment 24 preferable extends radially further than the outer surface 30 of the seal 18 but they can also extend co-extensively. Optionally, surface 24 can be eliminated in favor of two sloping surfaces 22 and 26 that join together to make a V shape and come to a point. The point can optionally penetrate the surrounding borehole wall for an anchoring grip. In either case it is preferred that the apex of tapers 22 and 26 or the radial position of a parallel to the axis surface 24 be the furthest extending location for protection of the seals 18 during run in.

Figure 4:
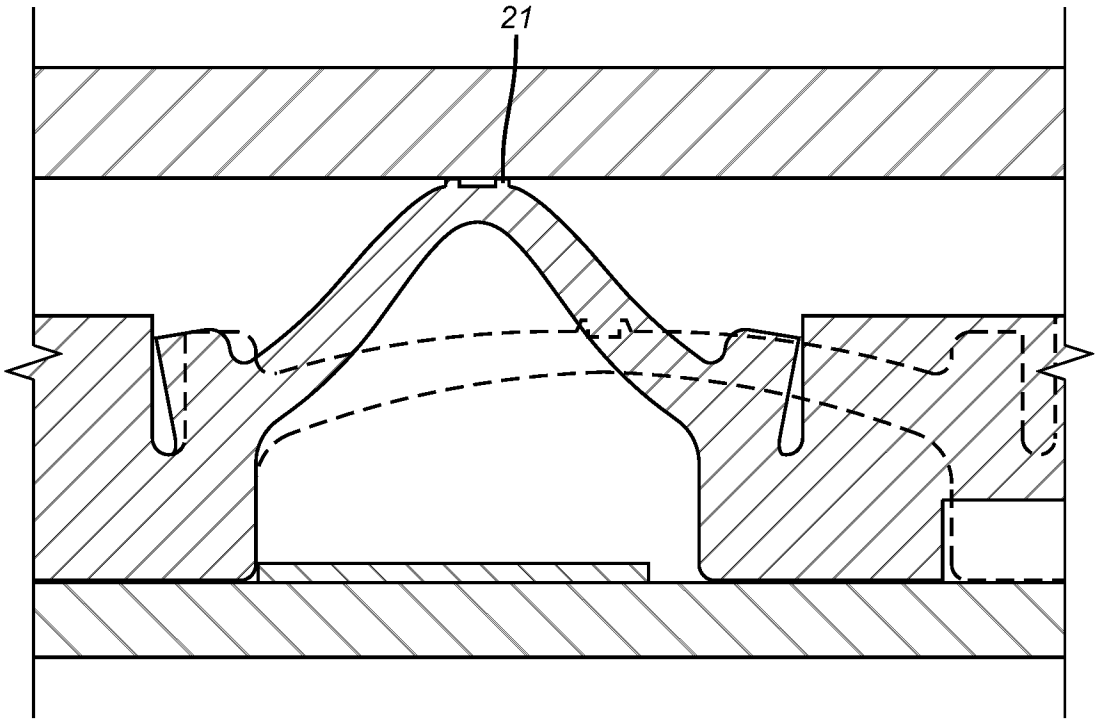
FIG. 4 is a two segment bump in the extended position from axial compression of the mandrel that shrinks its length as well as shrinkage from radial expansion.

The swage 32 has an outer dimension 34 that in the preferred embodiment is no larger than internal diameter 36 of the humps 20, with an exception as pointed out below. In this manner as expansion occurs, with the mandrel 14 preferably in compression but can also occur with the mandrel 14 in tension, the valleys 28 disappear. The expansion in the radial direction reduces the axial length of the mandrel 14 so that the bumps are pushed radially outwardly against the borehole wall as shown in FIG. 4. Optionally the humps 20 can have an external surface treatment 21 such as a surface roughness or hard particles that will dig into the surrounding borehole wall to act as an anchor.

Another option to the preferred embodiment is to size the swage outer dimension 34 to be larger than internal diameter 36 so that as a result of expansion the humps 20 are radially expanded beyond their run in drift outer dimension.

Figure 3:
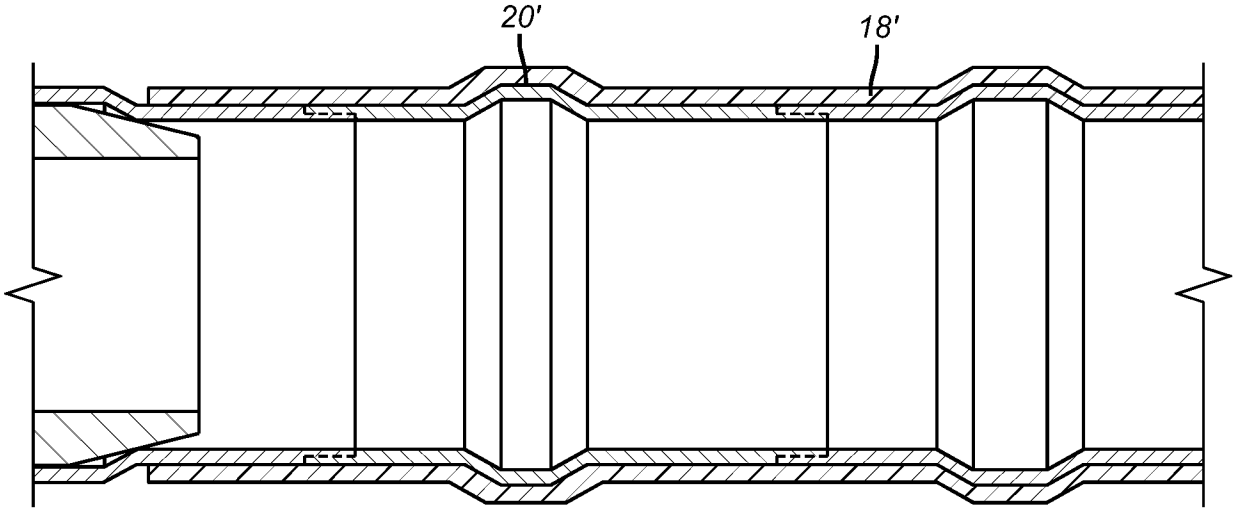
FIG. 3 is a variation of the FIG. 2 design with a sealing material mounted over the bumps that straddle the recess location where the sealing elements are disposed.

Another option for the humps 20 is shown in FIG. 3 where the sealing element 18' is continuous and runs right over the humps 20'. In this version the sealing material can sustain so wear in the region of the humps 20' and on expansion of the mandrel 14' that shrinks the mandrel 14' longitudinally, the result of outward movement of the humps 20' is to extend a seal in that location with an added anchoring benefit that is less dramatic than the FIG. 2 embodiment.

Figure 3A:
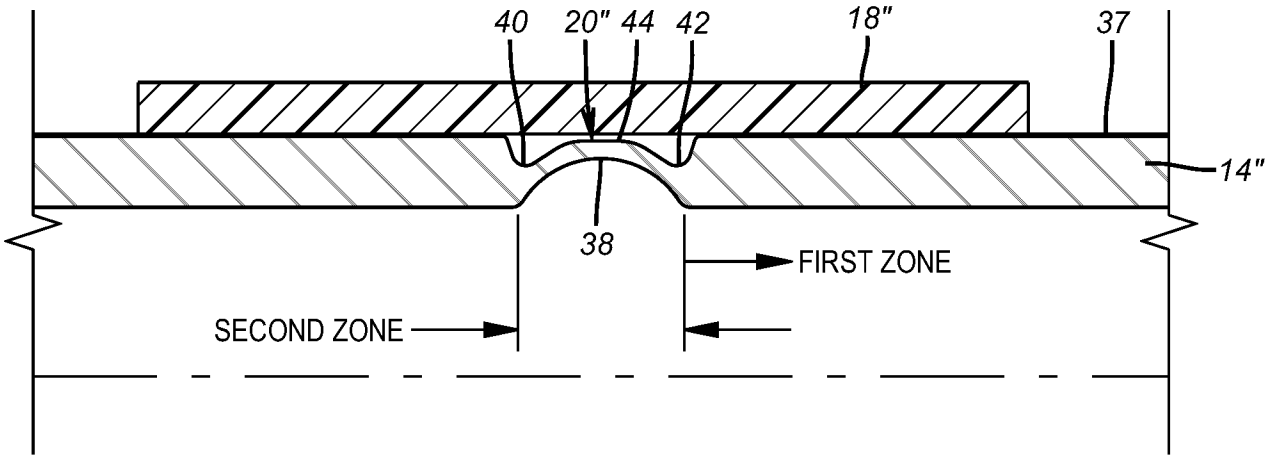
FIG. 3*a* is a variation of the FIG. 3 design where the bumps are configured for radial movement resulting from longitudinal shrinkage from radial mandrel expansion.

FIG. 3*a* shows mandrel 14" covered with sealing element 18" with hump 20" preferably extending radially about as far as the outer surface 37 of mandrel 14". The hump 20" is preferably a continuous arcuate inner surface 38 that externally defines opposed valleys 40 and 42 on opposed sides of peak surface 44. In this embodiment the expansion that causes longitudinal shrinkage induces collapse of mandrel 14" at valleys 40 and 42 that drives surface 44 into the seal 18" to enhance the sealing against the borehole wall.

Those skilled in the art will appreciate that in the FIG. 2 embodiment the valleys 28 defined by the humps 20 allow for a thicker element 18 that is protected for run in by the humps 20. The expansion with swage 32 does not have to expand the peak of the humps as for example segment 24. The connections 16 being under seals 18 can even leak slightly from expansion but the presence of the seal 18 can close off that leak path. Optionally the seal elements can swell. All the seal elements need not be identical and some can swell while others do not. In some applications where damage during run in is a big concern, the seals 18 can extend radially further than the bumps 20. The humps 20 extend radially as a result of longitudinal shrinkage from expansion with the swage 32 and the shape of the bumps can be as shown in FIG. 2 or varied to take out segment 24 so they are more pointed. The outer dimension of the humps 20 can create an anchor for the packer and it can also bite into the surrounding tubular for a metallic seal as an option. The shape of the humps 20 promotes their radial growth as a result of expansion. External surface roughening or hard particles can also enhance the ability of the humps 20 to be packer anchors. Optionally, as shown in FIG. 3 the humps 20' can be covered with a seal material so that the sealing ability is improved as the humps 20' drive segments of the seal 18' that is a single long sleeve parts of which are nested in recesses for run in between the humps 20' against the borehole wall for an enhanced seal. The continuous nature of the long seal in FIG. 3 with the bumps that push it out further improves the performance of the assembly as compared to the FIG. 2 design with a sacrifice of some protection of the seal 18' during run in.

In the FIG. 3*a* embodiment the humps 20" are fabricated in a manner using the arc to allow them to extend as a result of longitudinal shrinkage from expansion so as to push the seal that extends over them out to the borehole wall. Optionally the humps 20" of FIG. 3*a* can be exposed and used in replacement of the humps 20 in FIG. 2. The valleys 40 and 42 assist in the outward growth due to mandrel shrinkage from expansion. As a result of expansion of mandrel 14" the humps 20" can extend further than the mandrel 14". For run in it is preferred to have the humps 20" extend radially as far as the outer seal dimension but having the bumps extend slightly more as an aid to holding the element 18" in place is also contemplated.

The above description is illustrative of the preferred embodiment and many modifications may be made by those skilled in the art without departing from the invention whose scope is to be determined from the literal and equivalent scope of the claims below.

We claim:

1. An expandable packer for subterranean use to engage a borehole wall, comprising:

a mandrel having a passage therethrough, said passage having a first internal dimension that is constant for a predetermined length defining at least one first zone and a second internal dimension larger than said first internal dimension to define at least one second zone;

said second zone comprising a multidimensional shape with opposed surfaces that either are joined together or that are separated by an intermediate surface to define an empty volume such that expansion of said first zone causes incremental radial expansion of said second zone that increases the internal dimension of said second zone incrementally beyond the expanded internal diameter of said first zone due to opposed sloping surfaces in said second zone moving toward each other as said mandrel shrinks axially from first zone expansion; and at least one seal mounted externally to said mandrel in said first zone and selectively pushed from within by said mandrel to engage the borehole wall without mandrel penetration into said seal.

2. The packer of claim 1, wherein:

said second zone radially enlarging as a result of longitudinal shrinkage from at least one of compressive loading of said mandrel and radial expansion of said mandrel in said first zone.

3. The packer of claim 2, wherein:

said second zone of said mandrel extending at least as far radially as said seal before said mandrel is expanded.

4. The packer of claim 2, wherein:

said seal overlays a connection in said mandrel.

5. The packer of claim 2, wherein:

said first zone is flanked by a pair of said second zones on opposing sides thereof

6. The packer of claim 5, wherein:

said second zones define a valley therebetween and external to said mandrel.

7. The packer of claim 6, wherein:

said multidimensional shape comprised tapered segments meeting at a point.

8. The packer of claim 7, wherein:

said point penetrates the borehole wall when said first zone is expanded.

9. The packer of claim 7, further comprising:

a swage for expansion of said mandrel whose outer dimension is smaller than an internal dimension of said point before expansion starts.

10. The packer of claim 7, further comprising:

a swage for expansion of said mandrel whose outer dimension is larger than an internal dimension of said point before expansion starts.

11. The packer of claim 2, wherein:

said seal extends to both said first and second zones.

12. The packer of claim 2, wherein:

said mandrel comprises alternating first and second zones and said seal extends in said first and second zones.

13. The packer of claim 2, wherein:

said second zone radially enlarging as a result of longitudinal shrinkage from both compressive loading of said mandrel and radial expansion of said mandrel in said first zone.

14. The packer of claim 1, wherein:

said multidimensional shape comprises tapered segments separated by a substantially parallel segment with respect to an axis of said passage.

15. The packer of claim 14, further comprising:

a swage for expansion of said mandrel whose outer dimension is smaller than an internal dimension of said substantially parallel segment before expansion starts.

16. The packer of claim 14, further comprising:

a swage for expansion of said mandrel whose outer dimension is larger than an internal dimension of said substantially parallel segment before expansion starts.

17. The packer of claim 1, wherein:

said multidimensional shape has an outer surface with a surface treatment to enhance grip against the borehole wall.

18. The packer of claim 1, wherein:

said seal is disposed adjacent a valley.

19. The packer of claim 1, wherein:

opposed surfaces of said second zone have an arcuate shape.

20. The packer of claim 19, wherein:

said arcuate shape is flanked by exterior valleys in an outer surface of said mandrel.

21. The packer of claim 19, wherein:

said arcuate shape has an outer surface that extends radially at least as far as an outer surface of said seal in an adjacent first zone.

22. The packer of claim 19, wherein:

said seal extends over said arcuate shape and adjacent said valleys.

23. The packer of claim 19, wherein:

said arcuate shape has an outer surface with a surface treatment to enhance grip against the borehole wall.

* * * * *